United States Patent [19]

Mauthe et al.

[11] 3,995,130

[45] Nov. 30, 1976

[54] ARC QUENCHING CHAMBER COMPONENT STRUCTURE FOR CIRCUIT BREAKERS OPERATING WITH PRESSURIZED GAS

[75] Inventors: Gerhard Mauthe, Birmenstorf; Klaus Ragaller; Ekkehard Schade, both of Neuenhof, all of Switzerland

[73] Assignee: BBC Brown Boveri & Company Limited, Baden, Switzerland

[22] Filed: Feb. 28, 1974

[21] Appl. No.: 446,778

[30] Foreign Application Priority Data

Mar. 20, 1973 Switzerland ..... 4018/73

[52] U.S. Cl. ..... 200/148 G; 200/148 A

[51] Int. Cl.[2] ..... H01H 33/60

[58] Field of Search ..... 200/148 R, 148 A, 148 G

[56] References Cited

UNITED STATES PATENTS

| | | | |
|---|---|---|---|
| 3,150,245 | 9/1964 | Leeds et al. | 200/148 G |
| 3,555,227 | 1/1971 | Cromer et al. | 200/144 R |
| 3,668,352 | 6/1972 | Teijeiro | 200/148 A |
| 3,670,124 | 6/1972 | Teijeiro | 200/148 A |
| 3,670,125 | 6/1972 | Teijeiro | 200/148 A |

*Primary Examiner*—Robert S. Macon

*Attorney, Agent, or Firm*—Pierce, Scheffler & Parker

[57] ABSTRACT

A structural component such as nozzle-forming member to be utilized in conjunction with the arc quenching chamber of an electrical circuit breaker operating with a pressurized gaseous fluid such as $SF_6$ and made from a polytetrafluoroethylene composition that is gas-emissive under influence of heat generated by the arc in the vicinity of the nozzle is provided with a system of gas-conducting passageways to permit such gas to escape from sub-surface cavities formed by deterioration of the composition rather than accumulate therein which leads ultimately to undersirable chipping off of pieces of the surface. These passageways may be constituted by a system of blind holes or by a system of grooves.

7 Claims, 2 Drawing Figures

Figure 1:
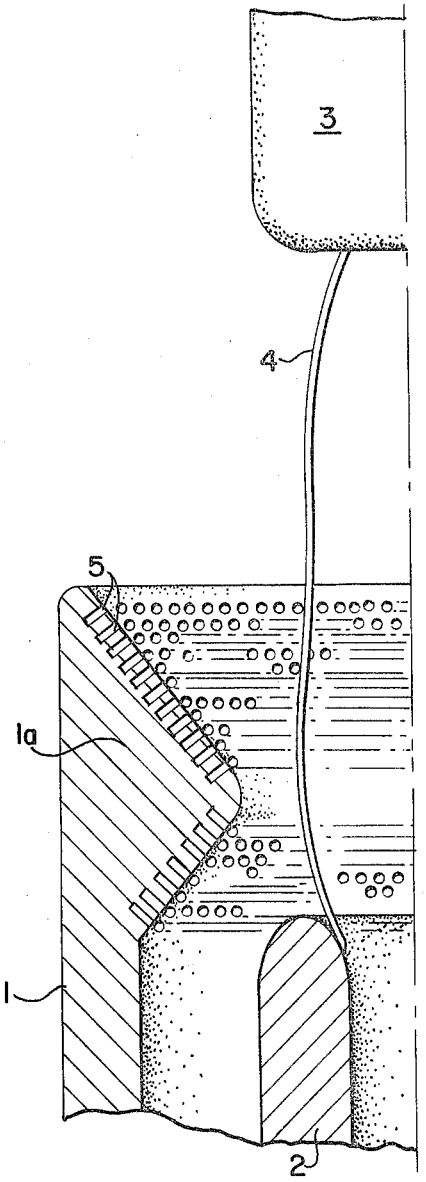

ARC QUENCHING CHAMBER COMPONENT STRUCTURE FOR CIRCUIT BREAKERS OPERATING WITH PRESSURIZED GAS

The present invention relates to an improvement in the construction of components utilized in conjunction with the arc quenching chambers of electrical circuit breakers operating with pressurized gas and especially sulphur hexafluoride ($SF_6$). Such components are frequently made from a material such as polytetrafluoroethylene which will emit gases under the influence of heat generated by the switching arc.

It is known, for example, from German Patent No. 874,929 to construct such arc quenching components, or at least portions thereof from polymeric, fluorine-containing ethylenes which may contain fillers, for example, fused silica. German utility model Patent No. 1,803,973 discloses construction of such components, particularly for use in $SF_6$ pressurized gas circuit breakers, made from polytetrafluoroethylene mixed with silicates (Teflon). Finally, it is known from German published Patent Application DT-OS 1,490,589 to utilize polytetrafluoroethylene sintered under pressure for the construction of those components of the quenching chamber of a low-fluid type circuit breaker which are subjected to the arc drawn between the contacts as they disengage.

It has been found, however, that under the influence of switching arcs of high current intensity, the surfaces of such components made from polytetrafluoroethylene compositions will suffer damage, as manifested by the chipping-off of pieces of the surface having a magnitude of several cubic millimeters. This chipping-off is attributable to the fact that small cavities will form beneath the surface subjected to the arc up to a depth of some millimeters due to decomposition of the material. These cavities then fill with gases or vapors under high pressure, and will eventually cause chipping-off of the corresponding surface portions.

The object of the present invention is to eliminate such surface damage to these components because otherwise certain valuable characteristics thereof, e.g. their ability to insulate electrically as well as other functions could be influenced adversely and undesirably. In accordance with the invention, it is proposed that at least a portion of the surface of such components be provided with discharge-outlets which permit any gases formed within such sub-surface cavities to freely escape therefrom rather than build up within the cavities. This objective can be accomplished, for example, by locating a system, i.e. a large number of blind holes below the surface of the components to serve as passageways for exit of the gas. The diameter of such blind holes is maintained relatively small, at preferably a maximum of 1 millimeter. The depth of the blind holes below the surface should not exceed 5 millimeters. In order to effectively protect the surface within the zone of arc influence, the blind holes should be placed at a distance from each other not greater than 5 millimeters.

In lieu of blind holes, it is also possible to utilize other configurations, such as a system of grooves, which will serve to permit escape of gases from the sub-surface regions of the component.

Figure 2:
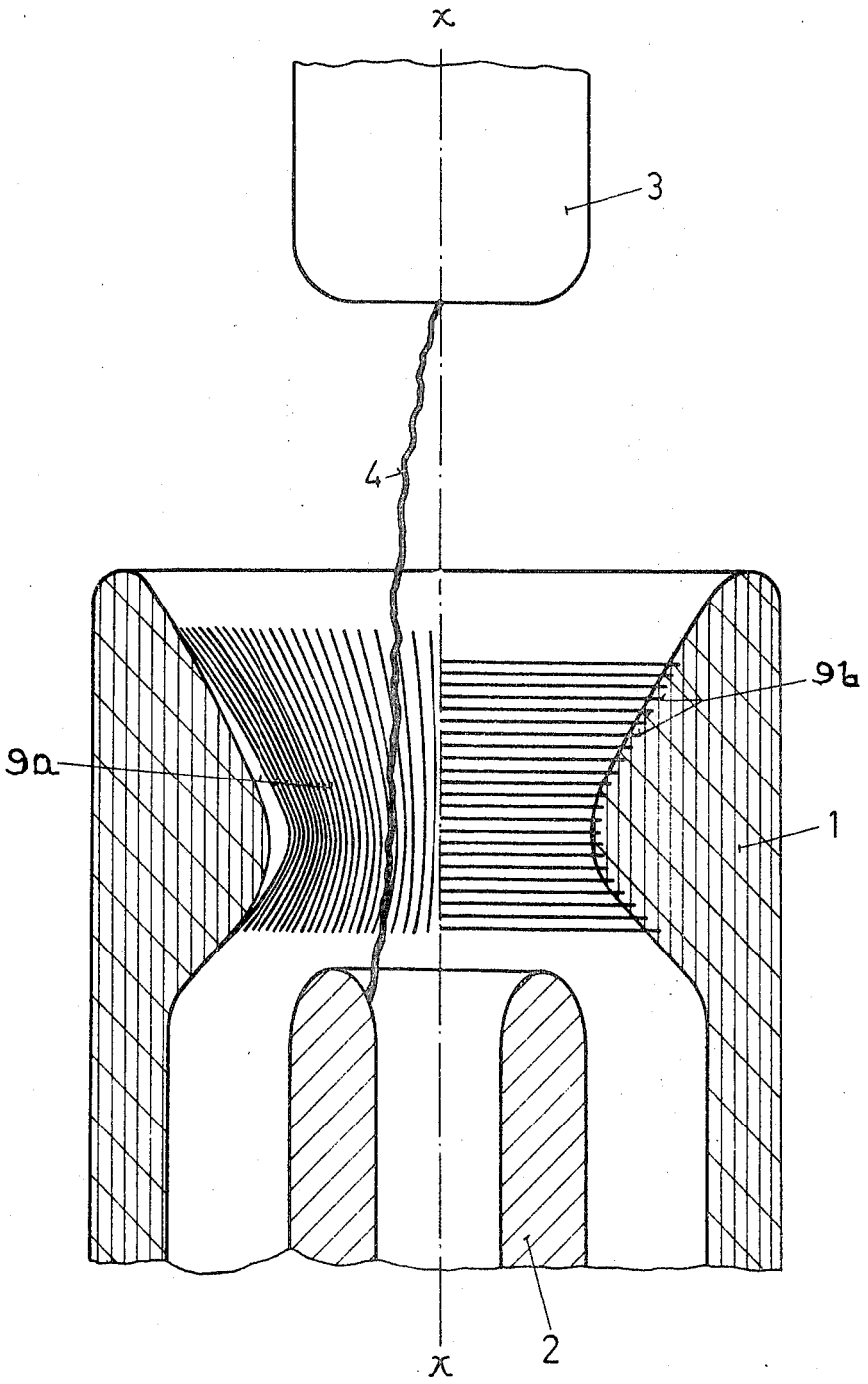

In the accompanying drawings:

FIG. 1 is a partial longitudinal view through a circuit breaker structure wherein the part to be protected against surface damage is constituted by a nozzle member made of insulating material for discharge of pressurized gas and within which an arc is drawn as the contact members disengage under load, and the inner surface of the nozzle is provided with a large number of blind holes for permitting gas formed within cavities in the nozzle body structure to escape; and FIG. 2 is a view also similar to FIG. 1 and wherein a system of grooves is located in the inner surface of the nozzle to permit escape of gas forming within cavities in the body of the nozzle.

With reference now to FIG. 1, the component to be protected against surface damage is constituted as a tubular member 1 made from a polytetrafluoroethylene composition, one end of which is formed as a nozzle 1a for discharge of the pressurized gas, e.g. $SF_6$ to facilitate quenching of the arc 4 drawn between the circuit breaker contact members 2 and 3 as they disengage. In accordance with the invention, the inner surface of this nozzle portion 1a which is subjected to a very high degree of thermal stress is provided with a large number of blind holes 5. The diameter of these holes is maintained relatively small, at preferably a maximum of 1 millimeter, and their depth preferably does not exceed 5 millimeters. In order to effectively protect the surface within the zone subjected to the arc, the blind holes should be located at a distance from each other not exceeding 5 millimeters.

In the embodiment according to FIG. 2 the system of gas-conducting passageways to permit the gas to escape from sub-surface cavities formed by deterioration of the nozzle-forming member 8 is constituted by a large number of relatively narrow grooves. Two different embodiments for these grooves having a maximum width of preferably 1 millimeter are illustrated. For the structure depicted by the section-half to the left of the axis, these grooves *9a* are seen to extend in a substantially axial direction following the contour of the nozzle in that direction. For an alternative structure depicted by the section-half to the right of the axis x—x the grooves *9b* are seen to extend azimuthally and have a ring-shaped configuration. In both cases it is preferable to make the depth of these grooves not greater than 5 millimeters and to maintain the distance between adjacent grooves as small as possible, which at the most should not exceed 5 millimeters.

We claim:

1. A structural component utilized in conjunction with the arc quenching chamber of an electrical circuit breaker operating with pressurized gaseous fluid such as $SF_6$ and which is made from a polytetrafluoroethylene composition that is gas emissive under the influence of heat generated by the arc, the improvement wherein to permit escape of such gas from sub-surface cavities formed by deterioration of the composition rather than accumulate therein and thereby minimize structural damage, the portion of the interior surface of said component subjected to heat from the arc is provided with a system of gas-release passageways extending from said interior surface into the body of said component and terminating therein, said gas-release passageways having a lateral dimension not exceeding 1 millimeter, a depth not exceeding 5 millimeters, and a mutual spacing not exceeding 5 millimeters.

2. An electrical circuit breaker structural component made from a polytetrafluoroethylene composition as defined in claim 1 and wherein said system of gas-release passageways is constituted by a system of blind holes.

3. An electrical circuit breaker structural component made from a polytetrafluoroethylene composition as defined in claim 1 and wherein said system of gas-release passageways is constituted by a system of grooves.

4. An electrical circuit breaker structural component as defined in claim 3 which includes a nozzle through which the pressurized gaseous fluid passes for quenching the arc drawn through the nozzle, and wherein the interior surface of said nozzle is provided with said system of grooves.

5. An electrical circuit breaker structural component as defined in claim 4 wherein said grooves extend in an azimuthal direction relative to the axis of the nozzle.

6. An electrical circuit breaker structural component as defined in claim 4 wherein said grooves extend substantially in the direction of the axis of the nozzle.

7. An electrical circuit breaker structural component as defined in claim 1 which includes a nozzle made from a polytetrafluoroethylene composition and through which the pressurized gaseous fluid passes from quenching the arc drawn through the nozzle, and wherein the interior surface of said nozzle is provided with said system of gas-release passageways in the form of blind holes.

* * * * *